US005932062A

United States Patent [19]

Manser

[11] Patent Number: 5,932,062

[45] Date of Patent: Aug. 3, 1999

[54] AUTOMATED SEALANT APPLICATOR

[76] Inventor: Russell D. Manser, 12259 Dentonview, Fenton, Mich. 48430

[21] Appl. No.: 08/738,369

[22] Filed: Oct. 25, 1996

Related U.S. Application Data

[60] Provisional application No. 60/007,020, Oct. 25, 1995.

[51] Int. Cl.[6] ..... B05B 12/08

[52] U.S. Cl. ..... 156/357; 156/356; 156/360; 156/107; 118/669; 118/680; 364/469.02

[58] Field of Search ..... 156/107, 350, 156/356, 357, 360, 578; 118/669, 676, 680, 681; 364/167.01, 468.01, 468.24, 469.02

[56] References Cited

U.S. PATENT DOCUMENTS

| | | | |
|---|---|---|---|
| 3,962,024 | 6/1976 | Stehl | 156/107 X |
| 4,145,237 | 3/1979 | Mercier et al. | 156/107 |
| 4,234,372 | 11/1980 | Bernhard et al. | 156/356 |
| 4,519,962 | 5/1985 | Schlienkamp | 156/107 X |
| 4,559,001 | 12/1985 | Wiedenhofer et al. | 156/107 X |
| 4,564,410 | 1/1986 | Clitheros et al. | 156/356 |
| 4,769,105 | 9/1988 | Lisec | 156/107 X |
| 4,789,417 | 12/1988 | Komatsu et al. | 156/356 |
| 5,136,974 | 8/1992 | Lisec | 118/673 |
| 5,167,756 | 12/1992 | Lenhardt | 156/578 |

*Primary Examiner*—David A. Simmons
*Assistant Examiner*—Paul M. Rivard
*Attorney, Agent, or Firm*—Young & Basile, P.C.

[57] ABSTRACT

An automated apparatus for applying sealant, for example to insulated glass, is disclosed. The apparatus comprises a computer control and a support structure on which is movably disposed a sealant applicator. The sealant applicator is selectively positionable along at least one axis via the computer control one or more sensors operate to provide the computer control with data regarding sealant application as the sealant is applied. The computer control is further operative to both determine the depth of sealant to be applied, and to effect positioning of the sealant applicator in response to data from the one or more sensors such that sealant applied does not exceed the determined depth.

15 Claims, 5 Drawing Sheets

AUTOMATED SEALANT APPLICATOR

REFERENCE TO PRIOR APPLICATION

This application claims the benefit of a prior U.S. Provisional Application Ser. No. 60/007,020, filed Oct. 25, 1995.

FIELD OF THE INVENTION

The present invention relates to insulated glass and more particularly to an apparatus facilitating the precise, automated application of sealant to such glass.

BACKGROUND OF THE INVENTION

Insulated glass comprises two or more panes of glass positioned in parallel-opposed fashion relative to each other by spacers to define a void therebetween. The spacers typically comprises a plurality of elongate metal elements each coextensive with one of the opposed pair of edges of the panes. The spacers are further positioned proximate but at a distance inward from the edges of the opposed panes of glass so as to define a continuous peripheral channel. During manufacture, this peripheral channel is typically filled with sealant to provide an hermetic barrier between the ambient air and the void between the panes of glass.

Filling the channel with sealant is commonly performed by one or more individuals, each manually operating a sealant applicator. Unfortunately, the manual nature of sealant application makes it a laborious and repetitive task. And even the most experienced worker will frequently apply the sealant in an inconsistent or uneven manner and will often accidentally apply sealant to an exposed surface on one or more of the panes of glass.

SUMMARY OF THE DISCLOSURE

Accordingly, it is an object of the present invention to provide an apparatus enabling the precise, uniform application of sealant to insulated glass.

Yet another object of the present invention is to provide for such an apparatus that is further automated, thereby reducing or eliminating human error.

These and other objects and advantages of the present invention will become apparent upon reference to the drawings and the specification, wherein an automated apparatus is disclosed for applying sealant to insulated-type glass. The apparatus comprises a support structure including a carriage provided thereon, the carriage rectilinearly positionable along a first axis via first positioning means. Sealant applicator means pivotally disposed on the carriage are selectively rotatably positionable via rotary positioning means, as well as selectively rectilinearly positionable along second and third non-parallel axes via second and third positioning means. The sealant applicator means further include sensor means for detecting the amount of sealant applied to the insulated glass. Each of the first, second, and third positioning means, as well as the rotary positioning means are operable by control means to automatically selectively rotate the sealant applicator means, as well as selectively move the sealant applicator means rectilinearly along the first, second, and third non-parallel axes. The control means are further responsive to the sensor means in operating the positioning means, such that the sealant is applied uniformly to the insulated glass.

DESCRIPTION OF THE ILLUSTRATED EMBODIMENT

Figure 1:
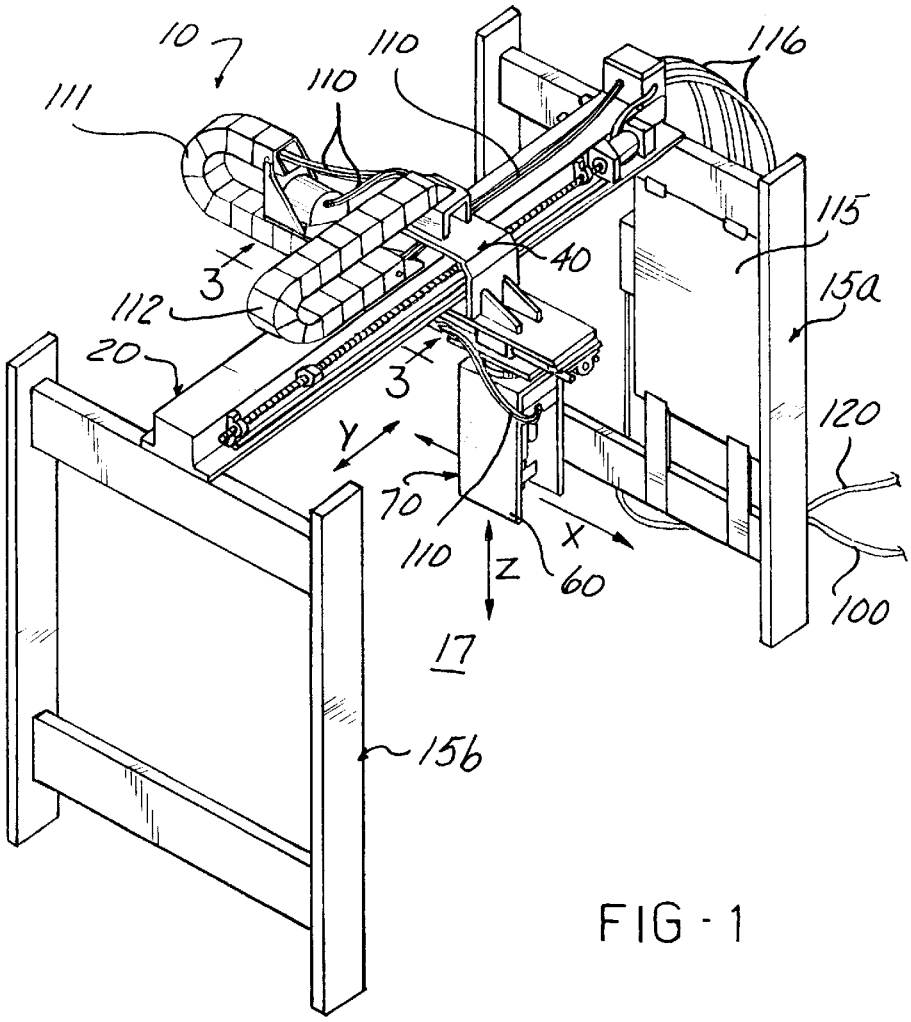
FIG. 1 is a perspective view of the apparatus of the invention.
Figure 2:
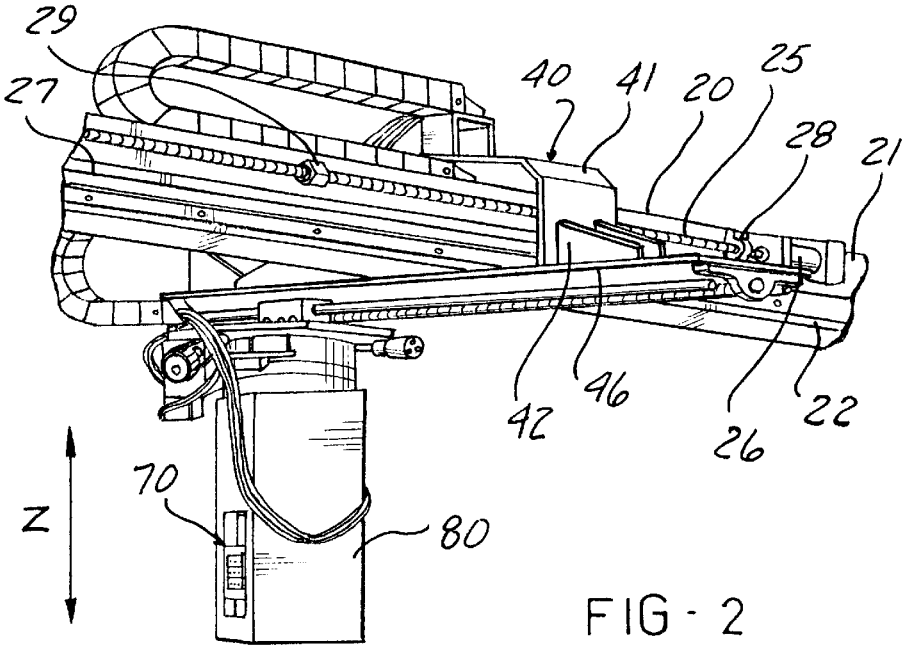
FIG. 2 is a perspective view of the positioning means of the present invention.

Turning first to FIGS. 1 and 2, the apparatus 10 of the present invention generally comprises an arch-like, steel support structure comprising a horizontal cross beam 20 suspended between first 15*a* and second 15*b* vertically oriented supports. A carriage 40 including sealant applicator means 70 pivotally depending therefrom is moveably disposed on cross beam 20; carriage 40 and sealant applicator means 70 each being further selectively rectilinearly positionable with respect to cross beam 20 along two non-parallel axes X and Y via first and second rectilinear positioning means. As depicted, sealant applicator means 70 are disposed within a housing 60 and are selectively rectilinearly positionable with respect thereto in a third non-parallel axis Z via third rectilinear positioning means. Rotatable positioning means provided between housing 60 and carriage 40 further permit the selective 360 degree rotation of sealant applicator means 70. Computer control means (not shown) in electrical communication with apparatus 10 through an appropriate data link 100 operate each of the first, second and third rectilinear positioning means, as well as the rotatable positioning means to automatically direct positioning of sealant applicator means 70 along axes X, Y and Z, thereby precisely controlling the application of sealant to a stack of insulated-type glass (not shown) as explained hereinbelow.

Figure 3:
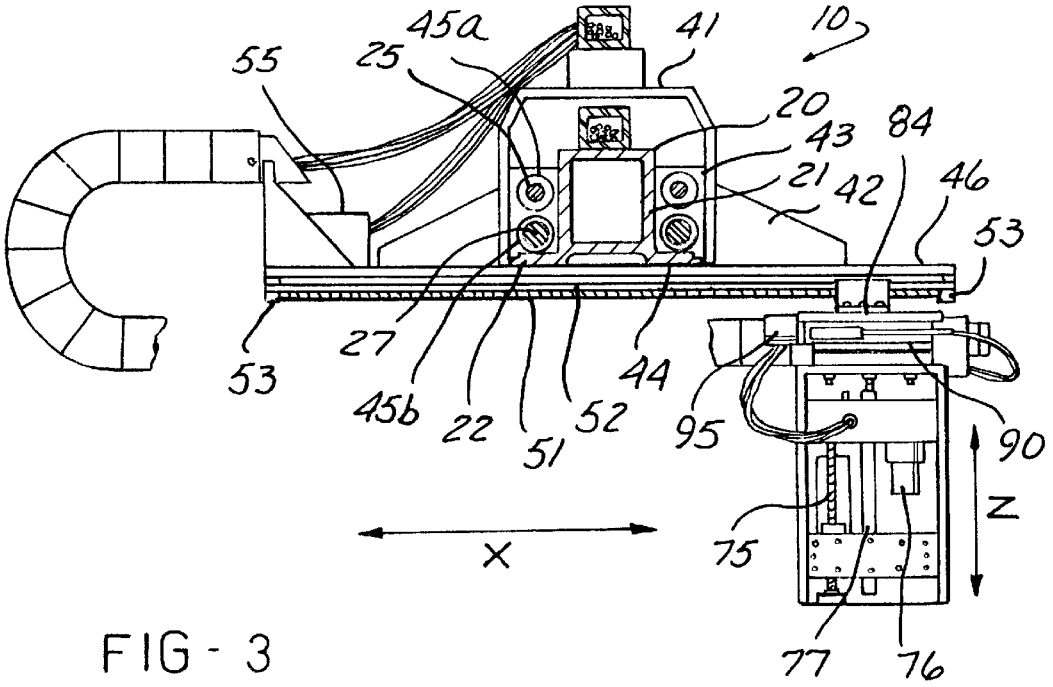
FIG. 3 is a medial cross section of the present invention.
Figure 4:
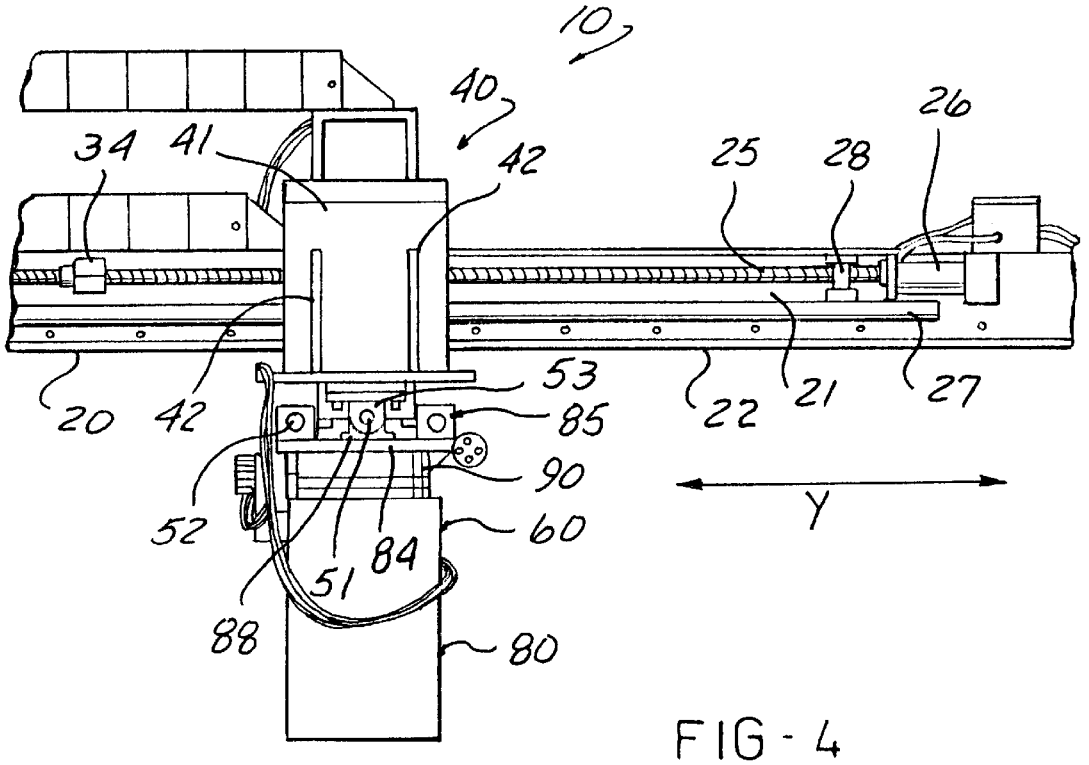
FIG. 4 is a partial lateral view of the carriage assembly and positioning means of the present invention.

Referring next to FIGS. 2, 3 and 4, cross beam 20 defines a substantially hollow, square-type beam including co-extensive lateral support shoulders 22 extending perpendicularly from the bottom edge of lateral surfaces 21. (FIG. 3) As shown in FIG. 4, the first rectilinear positioning means are disposed parallel with and in spaced relation to cross beam 20 and define a first axis Y of apparatus 10. These first rectilinear positioning means generally comprise an axially rotatable threaded shaft 25 rotatably driven by drive means such as the illustrated motor 26. Threaded drive shaft 25 extends along the principal length of cross beam 20 and is secured at its opposite distal ends thereto by means of eyelet brackets 28. A guide shaft 27 provided co-extensive with and parallel to drive shaft 25 is immovably fixed in similar spaced relation to cross beam 20. Guide shaft 27 ensures the smooth transition of carriage 40 along the first positioning means. A coaxial limiting-bolt 29 may be included at a desired position along drive shaft 25 to define the extent of travel of carriage 40 therealong. In the preferred embodiment, the above-described first positioning means are provided on each of opposing lateral surfaces 21 of cross beam 20.

Still referring to FIGS. 2, 3 and 4, carriage 40 comprises a horizontally-disposed platform 46 movably suspended from cross-beam 20 by a cowl 41 which, as shown, defines an essentially U-shaped metal covering provided over cross beam 20 and fixedly connected medially to a platform 46 such that equivalent lateral portions of the platform extend to either side of cross beam 20. (FIG. 3) A pair of vertically oriented struts 42 extending perpendicularly from either side of cowl 41 are fixed by welding or other comparable method along their lower edges to platform 46, thereby providing platform 46 with greater resistance to bending. Guide members 43 fixed to opposite interior surfaces of cowl 41 are provided adjacent lateral surfaces 21 of cross beam 20. Each guide member 43 includes a runner surface 44 corresponding to the transverse profile of each support shoulders 22. Guide members 43 further include bores 45*a* and 45*b* by which carriage 40 is movably associated with both drive shaft 25 and guide shaft 27, respectively. To that end, bore 45*a* is preferably threaded such that rotation of drive shaft 25 by motor 26 will drive carriage 40 therealong in a corresponding direction. The second rectilinear positioning means associated with carriage 40 define a second axis X of apparatus 10. These second rectilinear positioning means comprise an axially rotatable drive shaft 51 disposed parallel with and in spaced relation to the underside of platform 46. Drive shaft 51 is flanked by parallel, coextensive guide shafts 52. As shown, drive shaft 51 is rotatably fixed to platform 46 at its opposite distal ends by eyelet brackets 53 and is rotatably driven by drive means such as motor 55 provided on the upper surface of platform 46. A threaded drive element 88 disposed on support plate 84 comprises a threaded bore for receiving drive shaft 51. As with movement of carriage 40 along the first rectilinear positioning means, drive element 88 is movably associated with drive shaft 51 such that rotation thereof by motor 55 will drive housing 80 in a corresponding direction along axis X. Rotatable positioning means provided between housing 80 and carriage 40 comprise a turntable 90 rotatably driven by drive means such as motor 95. Turntable 90 is fixedly attached at its upper end to support plate 84, which support plate 84 is, in turn, movably associated with guide shafts 52 in a rotatably stationary position by means of guide members 85.

Figure 5:
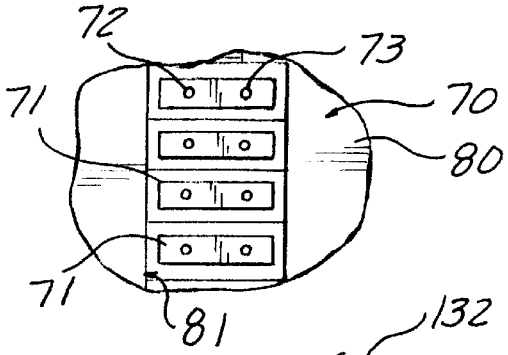
FIG. 5 is a frontal view of the sealant applicator means of the present invention.
Figure 6:
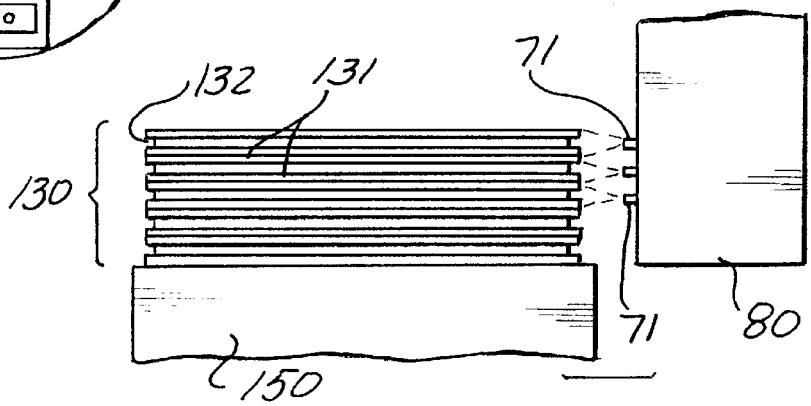
FIG. 6 is a lateral elevation illustrating the manner of sealant application in the present invention.

Sealant applicator means 70 are movably disposed within housing 80 which, as described, pivotally depends from and is selectively rotatably and rectilinearly positionable with respect to carriage 40. (FIGS. 3 and 5) Sealant applicator means 70 preferably comprise a plurality of sealant applicators 71 projecting from one surface of housing 80 through a rectangular-shaped opening 81. In the preferred form of the present invention, sealant applicators 71 are coaxially arranged in stacked relation to each other and are selectively vertically positionable via associated third positioning means. The spacing between each sealant applicator 71 is ideally such as to correspond to the dimensions of each channel 132 defined between opposing panes 131 of glass in an insulated glass assembly such as the stack 130 of insulated glass illustrated in FIG. 6. The third positioning means defines a third axis Z of apparatus 10. (FIG. 3) These third rectilinear positioning means generally comprise a vertically disposed, axially rotatable threaded shaft 75 on which is movably threadingly disposed sealant applicators 71. Drive means such as the illustrated motor 76 disposed within housing 80 rotatably drives shaft 75. Each sealant applicator 71 includes both a nozzle 73 through which sealant is delivered during operation of the present invention, as well as sensor means 72. In the preferred form, sensor means 72 comprise an optical sensor in communication with the above-described computer control means in a manner hereinafter explained. Sealant is fed from a supply source (not shown) to each sealant applicator 71 by a supply hose (not shown) communicating with nozzle 73. In the illustrated embodiment, only four such sealant applicators 71 are shown. Of course, any number of such sealant applicators may be incorporated into the present invention, according to a desired application. Alternately, a fixed number of sealant apparatus may be immovably disposed within housing 80. This embodiment is particularly envisioned where the number of channels to be sealed is constant.

Each of the foregoing rectilinear and rotatable positioning means for apparatus 10 are preferably electrical, and power supply lines 110 extend to each motor 26, 55, 75 and 95. (FIGS. 1, 3, and 4) In the illustrated embodiment, power supply lines 110 extending to each of motors 55, 75 and 95 are each at least partially disposed within a segmented sheath 111, 112 which prevent damage to the power supply lines 110 during either rectilinear or rotational movement of carriage 40. At vertical support 15*a*, power supply lines 110 are routed to a circuit board/fuse box 115 through rigid cylindrical housing 116. Master power supply line 120 extends from circuit board/fuse box 115 to a suitable electrical source, such as an outlet.

The computer control means (not shown) which dictate positioning of each of carriage 40 and housing 80 comprise a permanent, read-only memory including both a driving program for controlling the above-described rectilinear and rotary positioning means, as well as a spatial coordinate program. The spatial coordinate program includes data in the permanent memory defining a fixed, three-dimensional coordinate map corresponding to the area 17 beneath apparatus 10, the absolute center of which coordinate system is represented by a 0' position relative to each of the axes X, Y, and Z. The permanent memory further includes data defining the three-dimensional sizes of various articles of insulated glass (such as the stack 130 insulated glass depicted in FIGS. 7 through 10) relative to the coordinate map. Of course, it is also envisioned that the computer control means also include a writeable/erasable memory and data entry means such as an alphanumeric keypad, thereby permitting variable data—including data defining the three-dimensional sizes of various articles of insulated glass—to be entered.

In operation, a stack 130 of insulated-type glass articles are laid on a table 150 or other support surface in position within area 17 such that the geometric center of stack 130 corresponds to the 0'0'0' position of the computer coordinate system. (FIG. 7) The stack comprises a plurality of sheets of insulated glass 131, each sheet including a peripheral channel 132 therein. (FIG. 6) The computer control means then prompts an operator to select data from the permanent memory defining a three-dimensional shape corresponding to the dimensions of stack 130. These data are processed by the computer control means to define the movement cycle for apparatus 10 during which sealant is applied to stack 130.

Figure 7:
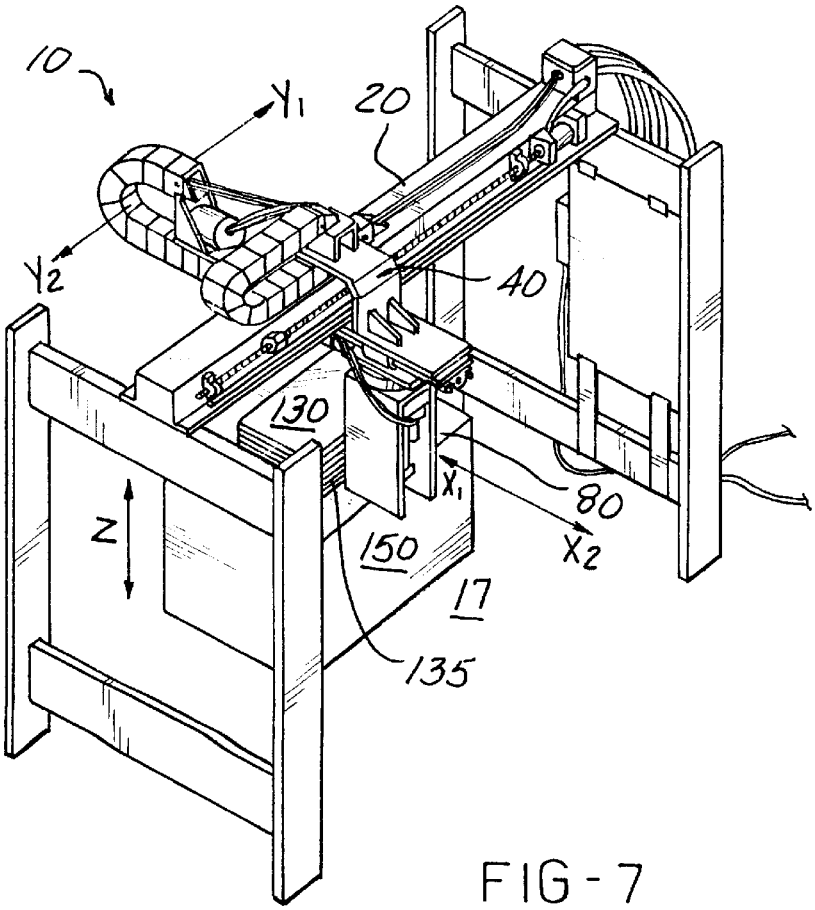
FIGS. 7 through 10 depict perspective views of the present invention during operation.
Figure 8:
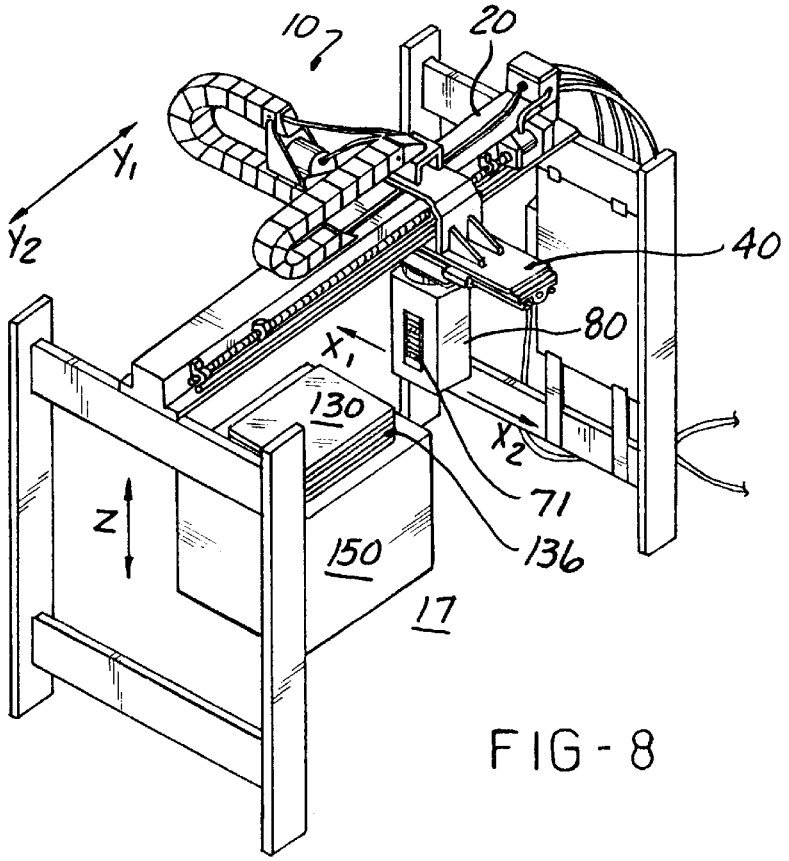

FIG. 7 depicts the commencement of a movement cycle, wherein the computer control means has effected the operation of the first positioning means to bring carriage 40 into a first starting position S1 along axis Y such that housing 80 is adjacent one end of a first side 135 of stack 130. The position of housing 80 along axis X is adjusted in similar fashion to bring housing 30 to within a predetermined distance relative to stack 130 to ensure maximum effective coverage thereof with sealant. Finally, sealant applicators 71 (not shown) are further positioned within housing 80 such that the position of the bottom-most sealant applicator 71 corresponds with the orientation of the bottom most channel 132 in stack 130.

As operation continues, housing 80 is directed along the Y axis in the direction Y1 by the computer control means, which operate the first rectilinear positioning means for a period of time equivalent to the distance from the starting position of housing 80 to the end of stack 130. The computer control means subsequently directs vertical repositioning of sealant applicators 71 upwards with respect to housing 80 via the described third rectilinear positioning means, such that each sealant applicator 71 is now disposed towards an unsealed channel 132. Movement of carriage 40 along cross beam 20 then continues along the axis Y2 until housing 30 reaches its starting position along the Y axis. In this manner, the computer control means directs the back and forth rectilinear movement of carriage 40 until channels 132 on the first 135 side of stack 130 have been covered.

Computer control means subsequently effects operation of the rotary positioning means to rotate housing 80 until sealant applicator means 70 are oriented so as to direct sealant towards channels 132 along the second 136 side of stack 130. (FIG. 8) Simultaneously, the computer control means effects operation of the first and second positioning means to move both housing 80 and carriage 40, respectively, thereby bringing sealant applicator means 70 into a second starting position S2 with respect to stack 130. Movement of housing 80 along axis X in the directions X1 and X2 is then effected by the computer control means in a manner similar to that described above, until the exposed channels 132 on the second 136 side of stack 130 have been sealed.

Figure 9:
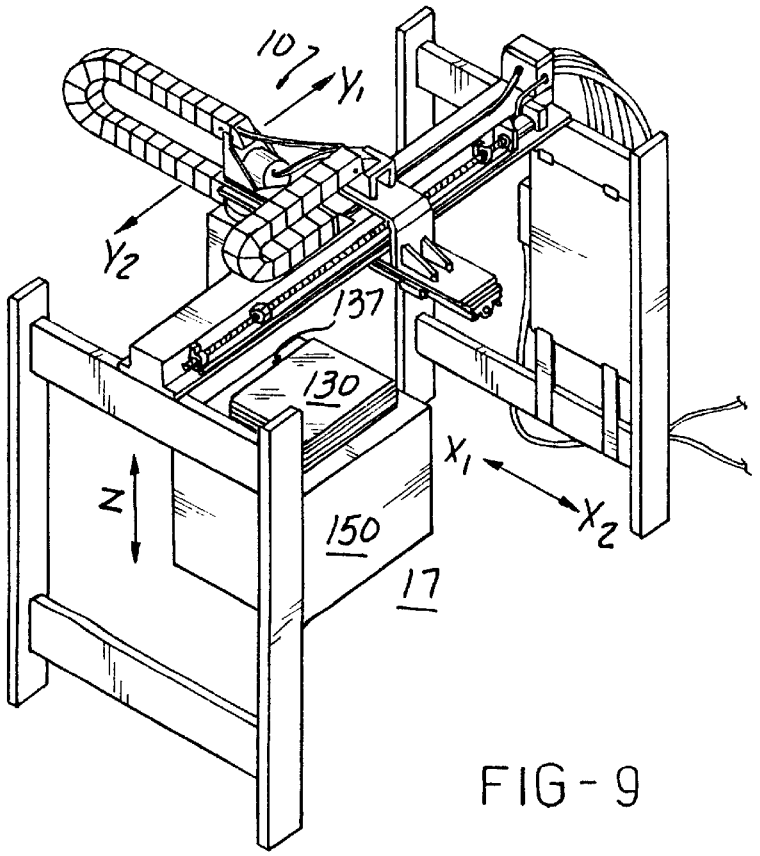
Figure 10:
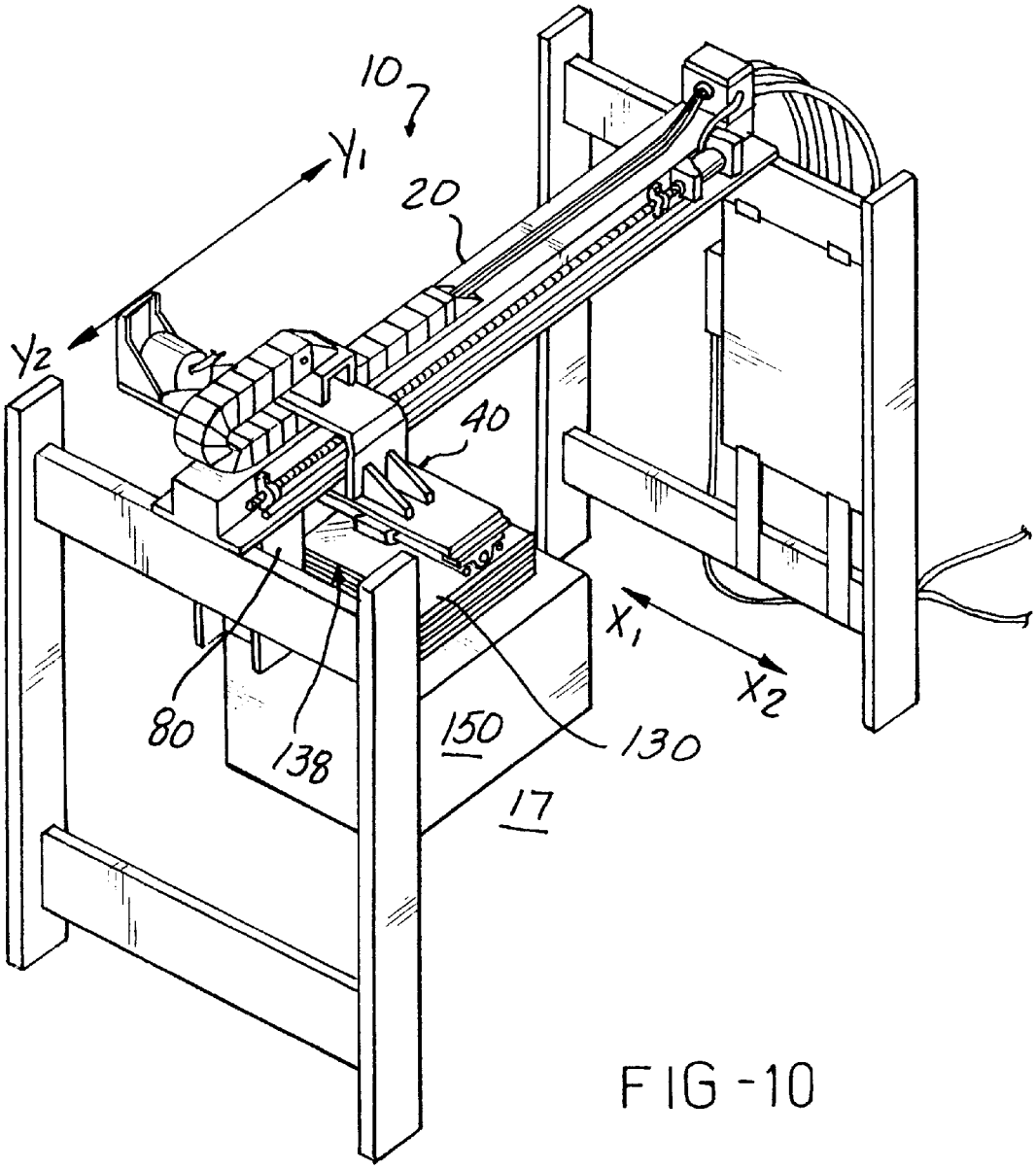

Referring next to FIG. 9, the computer control means effects operation of the rotary positioning means, as well as the first, second, and third rectilinear positioning means, to adjust the orientation of housing 80 with respect to stack 130 and bring sealant applicator means 70 into a third starting position S3 with respect to the third 137 side of stack 130. As described above, back and forth movement of carriage 40 along axis Y and up and down movement of sealant applicator means 70 along axis Z is then effected by the computer control means through operation of the first and second rectilinear positioning means, until channels 132 on third side 137 of stack 130 have been sealed.

To bring sealant applicator means 70 into an appropriate facing with respect to the fourth side 138 of stack 130, the computer control means again effects operation of the rotary positioning means, causing rotational movement of housing 80. (FIG. 10) Similarly, the computer control means effects operation of the first, second, and third rectilinear positioning means to bring sealant applicator means 70 into a fourth starting position S4 with respect to the fourth side 138 of stack 130. In similar fashion to the operation described above, the computer control means then effects movement of housing 80 along axis X in the directions X2 and X1, as well as the vertical repositioning of sealant applicator means 70 along the axis Z, until all channels 132 on fourth side 138 have been sealed.

To ensure that the application of sealant to channels 132 is uniform, the computer control means further receives data from sensor means 72, which sensor means 72 are calibrated to the 0'0'0' position of apparatus 10. Upon retrieval of dimension data from the permanent memory as described above, the computer control means determines a value D equal to the distance between channels 132 and sensor means 72 from any starting position S1 through at least S4. As sealant applicator means 70 is directed about the circumference of stack 130, sensor means 72 provide computer control means with instantaneous data regarding the depth of sealant applied to a given area in a channel 132. The computer control means processes these data and compares them to both the value D and a predetermined value representing the desired depth of sealant to be applied to channels 132. When the value D less the depth of sealant applied to a given area of channels 132 corresponds to a value equivalent to the outermost dimensions for that area of stack 130, the computer control means directs the positioning means to move sealant applicator means 20 such that no area of a channel 132 is applied sealant in an amount exceeding the width of the stack 130 for that area.

Of course, it will be appreciated that the foregoing is merely illustrative of one embodiment of the present invention, and many improvements and modifications thereto, apparent to those of skill in the art, are possible without departing from the spirit and broader aspects of the invention as set forth in the appended claims.

The invention in which an exclusive property or privilege is claimed is defined as follows:

1. An automated sealant applicator for applying sealant to insulated glass, comprising:

computer control means;

a support structure on which is movably disposed sealant applicator means;

positioning means operative via said computer control means to automatically selectively position said sealant applicator means along at least one axis;

sensor means operative to provide said computer control means with data regarding sealant application as the sealant is applied to the insulated glass; and wherein said computer control means are further operative to both determine the depth of sealant to be applied to the insulated glass, and to effect operation of said positioning means in response to said data from said sensor means such that sealant applied to the insulated glass does not exceed said determined depth.

2. The automated sealant applicator of claim 1, wherein said sealant applicator means are positionable along three non-parallel axes.

3. The automated sealant applicator of claim 2, wherein said positioning means include rotary positioning means, said rotary positioning means operative via said computer control means to rotate said sealant applicator means along one of said three non-parallel axes.

4. The automated sealant applicator of claim 3, wherein said positioning means further include at least first, second, and third rectilinear positioning means, said first, second, and third positioning means operative via said computer control means to position said sealant applicator means along said three non-parallel axes.

5. The automated sealant applicator of claim 4, wherein said axes are perpendicular with respect to each other, such that said sealant applicator means are positionable in three dimensions.

6. The automated sealant applicator of claim 1, wherein said sensor means comprise one or more optical sensors.

7. The automated sealant applicator of claim 5, wherein said computer control means are operative to automatically direct said rotary positioning means and said first, second, and third rectilinear positioning means such that said sealant applicator means automatically circumscribes a predetermined path in three-dimensions.

8. The automated sealant applicator of claim 5, said sealant applicator means being disposed within a housing disposed on a carriage, said housing including said third positioning means so as to position said sealant applicator means along one of said three perpendicular axes, said rotary positioning means being provided between said housing and said carriage to rotatably position said sealant applicator means along at least one of said three perpendicular axes by rotating said housing, and wherein said carriage is provided on said support structure and is rectilinearly positionable along two of said three perpendicular axes via said first and second rectilinear positioning means.

9. An automated sealant applicator for applying sealant to insulated glass, comprising:

computer control means;

a support structure on which is movably disposed sealant applicator means;

positioning means operative via said computer control means to automatically selectively position said sealant applicator means along at least three non-parallel axes, said positioning means including at least first, second, and third rectilinear positioning means operative via said computer control means to position said sealant applicator means along said three non-parallel axes, and rotary positioning means operative via said computer control means to rotate said sealant applicator means along one of said three non-parallel axes;

sensor means operative to provide said computer control means with data regarding sealant application as the sealant is applied to the insulated glass; and wherein said computer control means are operative to automatically direct said positioning means such that said sealant applicator means automatically circumscribes a predetermined path along said three non-parallel axes, and wherein said computer control means are further operative to both determine the depth of sealant to be applied to the insulated glass, and to effect operation of said positioning means in response to said data from said sensor means such that sealant applied to the insulated glass does not exceed said determined depth.

10. The automated sealant applicator of claim 9, wherein said at least three non-parallel axes are perpendicular with respect to each other, such that said sealant applicator means are positionable in three dimensions.

11. The automated sealant applicator of claim 10, wherein said sensor means comprise one or more optical sensors.

12. The automated sealant applicator of claim 10, said sealant applicator means being disposed within a housing disposed on a carriage, said housing including said third positioning means so as to position said sealant applicator means along one of said three perpendicular axes, said rotary positioning means being provided between said housing and said carriage to rotatably position said sealant applicator means along at least one of said three perpendicular axes by rotating said housing, and wherein said carriage is provided on said support structure and is rectilinearly positionable along two of said three perpendicular axes via said first and second rectilinear positioning means.

13. An automated sealant applicator for applying sealant to insulated glass, comprising:

computer control means;

a support structure on which is movably disposed a carriage having disposed thereon a housing, said housing including sealant applicator means;

sensor means operative to provide said computer control means with data regarding sealant application as the sealant is applied to the insulated glass;

positioning means operative via said computer control means to automatically selectively position said sealant applicator means along at least three non-parallel axes, said positioning means including at least first, second, and third rectilinear positioning means operative via said computer control means to position said sealant applicator means along said three non-parallel axes, and rotary positioning means operative via said computer control means to rotate said sealant applicator means along one of said three non-parallel axes, wherein said housing includes said third positioning means so as to position said sealant applicator means along one of said three non-parallel axes, said rotary positioning means are provided between said housing and said carriage to rotatably position said sealant applicator means along at least one of said three non-parallel axes by rotating said housing, and wherein said carriage is rectilinearly positionable along two of said three non-parallel axes via said first and second positioning means; and wherein said computer control means are operative to automatically direct said positioning means such that said sealant applicator means automatically circumscribes a predetermined path along said three non-parallel axes, and wherein said computer control means are further operative to both determine the depth of sealant to be applied to the insulated glass, and to effect operation of said positioning means in response to said data from said sensor means such that sealant applied to the insulated glass does not exceed said determined depth.

14. The automated sealant applicator of claim 13, wherein said at least three non-parallel axes are perpendicular with respect to each other, such that said sealant applicator means are positionable in three dimensions.

15. The automated sealant applicator of claim 14, wherein said sensor means comprise one or more optical sensors.

* * * * *